US012552626B2

(12) United States Patent
Morikawa et al.

(10) Patent No.: US 12,552,626 B2
(45) Date of Patent: Feb. 17, 2026

(54) MEDIA CONVEYING APPARATUS, MEDIA CONVEYING METHOD, AND NON-TRANSITORY RECORDING MEDIUM

(71) Applicant: PFU LIMITED, Kahoku (JP)

(72) Inventors: Syuichi Morikawa, Kahoku (JP); Kiichiro Shimosaka, Kahoku (JP)

(73) Assignee: PFU LIMITED, Kahoku (JP)

( * ) Notice: Subject to any disclaimer, the term of this patent is extended or adjusted under 35 U.S.C. 154(b) by 0 days.

(21) Appl. No.: 18/882,205

(22) Filed: Sep. 11, 2024

(65) Prior Publication Data

US 2025/0002283 A1 Jan. 2, 2025

Related U.S. Application Data

(63) Continuation of application No. PCT/JP2022/012426, filed on Mar. 17, 2022.

(51) Int. Cl.
*B65H 9/00* (2006.01)
*B65H 5/06* (2006.01)
(Continued)

(52) U.S. Cl.
CPC ..... *B65H 9/006* (2013.01); *B65H 5/062* (2013.01); *B65H 7/08* (2013.01); *B65H 7/14* (2013.01);
(Continued)

(58) Field of Classification Search
CPC ..... B65H 3/063; B65H 3/0669; B65H 5/062; B65H 7/08; B65H 7/14; B65H 9/006;
(Continued)

(56) References Cited

U.S. PATENT DOCUMENTS 5,453,852 A * 9/1995 Morikawa ..... H04N 1/00628 271/124
6,151,478 A * 11/2000 Katsuta ..... H04N 1/00602 399/374
(Continued)

FOREIGN PATENT DOCUMENTS

JP H03-111362 A 5/1991
JP 2000-211774 A 8/2000
(Continued)

OTHER PUBLICATIONS

International Search Report dated Apr. 12, 2022 for corresponding PCT Application No. PCT/JP2022/012426(3 pages) with English Translation (2 pages).
(Continued)

*Primary Examiner* — Prasad V Gokhale
(74) *Attorney, Agent, or Firm* — Womble Bond Dickinson (US) LLP

(57) ABSTRACT

A media conveying apparatus includes a feed roller, a first conveyance roller, a second conveyance roller, a motor, and a sensor. The circuitry determines whether a trailing end of each medium of media has passed the second conveyance roller and executes alignment of a leading end of the each medium at a position of the first conveyance roller. The circuitry stops the first conveyance roller or rotates the first conveyance roller in a reverse direction and controls the feed roller to align a leading end of a first medium among the media in a case where the circuitry determines that a trailing end of a second medium among the media preceding the first medium has passed the second conveyance roller when the sensor detects the leading end of the first medium.

9 Claims, 9 Drawing Sheets

(51) Int. Cl.
*B65H 7/08* (2006.01)
*B65H 7/14* (2006.01)

(52) U.S. Cl.
CPC ..... *B65H 9/008* (2013.01); *B65H 2553/412* (2013.01); *B65H 2701/1311* (2013.01); *B65H 2701/1313* (2013.01)

(58) Field of Classification Search
CPC ..... B65H 9/008; B65H 2553/412; B65H 2701/1311; B65H 2701/1313
See application file for complete search history.

(56) References Cited

U.S. PATENT DOCUMENTS

| | | | | |
|---|---|---|---|---|
| 2007/0048058 | A1 | 3/2007 | Koga et al. | |
| 2011/0089629 | A1* | 4/2011 | Furusawa | B65H 7/14 271/227 |
| 2013/0234387 | A1 | 9/2013 | Moto | |
| 2021/0087007 | A1 | 3/2021 | Morisaki et al. | |

FOREIGN PATENT DOCUMENTS

| | | | |
|---|---|---|---|
| JP | 2007-90801 | A | 4/2007 |
| JP | 2013-184819 | A | 9/2013 |
| JP | 2019-182590 | A | 10/2019 |
| JP | 2021-52381 | A | 4/2021 |

OTHER PUBLICATIONS

Written Opinion dated Apr. 12, 2022 for corresponding PCT Application No. PCT/JP2022/012426 (4 pages) with English Translation (4 pages).
International Preliminary Report on Patentability dated Sep. 10, 2024 for corresponding PCT Application No. PCT/JP2022/012426 (4 pages) with English Translation (4 pages).

* cited by examiner

MEDIA CONVEYING APPARATUS, MEDIA CONVEYING METHOD, AND NON-TRANSITORY RECORDING MEDIUM

CROSS-REFERENCE TO RELATED APPLICATIONS

This patent application is a continuation application of International Application No. PCT/JP2022/012426, filed on Mar. 17, 2022, in the Japan Patent Office, the entire disclosure of which is hereby incorporated by reference herein.

BACKGROUND

The present disclosure relates to a media conveying apparatus, a media conveying method, and a non-transitory recording medium.

For media conveying apparatuses such as scanners that convey and image media, an alignment function has been developed to correct the inclination of a conveyed medium. Specifically, the alignment function is to rotate a conveyance roller, which is used to convey media, for a predetermined period of time in a direction in which the medium is reversed and align the leading end of the medium.

SUMMARY

According to an embodiment of the present disclosure, a media conveying apparatus includes a feed roller, a first conveyance roller, a second conveyance roller, a motor, and a sensor. The feed roller feeds media. The first conveyance roller is located downstream from the feed roller in a media conveyance direction and conveys the media in the media conveyance direction by rotating in a forward direction. The second conveyance roller is located downstream from the first conveyance roller in the media conveyance direction and conveys the media in the media conveyance direction by rotating in the forward direction. The motor drives the first conveyance roller and the second conveyance roller simultaneously. The sensor is located upstream from the first conveyance roller in the media conveyance direction. The circuitry determines whether a trailing end of each medium of the media has passed the second conveyance roller and executes alignment of a leading end of the each medium at a position of the first conveyance roller by controlling the first conveyance roller and the feed roller. The circuitry stops the first conveyance roller or rotates the first conveyance roller in a reverse direction and controls the feed roller to align a leading end of a first medium among the media in a case where the circuitry determines that a trailing end of a second medium among the media preceding the first medium has passed the second conveyance roller when the sensor detects the leading end of the first medium.

According to an embodiment of the present disclosure, a media conveying method includes feeding media by a feed roller, driving a first conveyance roller and a second conveyance roller simultaneously by a motor, determining whether a trailing end of each medium of the media has passed the second conveyance roller, and executing alignment of a leading end of the each medium at a position of the first conveyance roller. The first conveyance roller is located downstream from the feed roller in a media conveyance direction and conveys the media in the media conveyance direction by rotating in a forward direction. The second conveyance roller is located downstream from the first conveyance roller in the media conveyance direction and conveys the media in the media conveyance direction by rotating in the forward direction. The executing includes stopping the conveyance roller or rotating the first conveyance roller in a reverse direction and controlling the feed roller to align a leading end of a first medium among the media in a case where the determining determines that a trailing end of a second medium among the media preceding the first medium has passed the second conveyance roller when the leading end of the first medium is detected by a sensor located upstream from the first conveyance roller in the media conveyance direction.

According to an embodiment of the present disclosure, a non-transitory recording medium stores a plurality of instructions which, when executed by one or more processors, causes the one or more processors to perform a method for controlling a media conveying apparatus including a feed roller, a first conveyance roller located downstream from the feed roller in a media conveyance direction, a second conveyance roller located downstream from the first conveyance roller in the media conveyance direction, and a sensor. The method includes determining whether a trailing end of each medium of media has passed the second conveyance roller, and executing alignment of a leading end of the each medium at a position of the first conveyance roller. The executing includes stopping the first conveyance roller or rotating the first conveyance roller in a reverse direction and controlling the feed roller to align a leading end of a first medium among the media in a case where the determining determines that a trailing end of a second medium among the media preceding the first medium has passed the second conveyance roller when the leading end of the first medium is detected by the sensor.

BRIEF DESCRIPTION OF THE DRAWINGS

A more complete appreciation of embodiments of the present disclosure and many of the attendant advantages and features thereof can be readily obtained and understood from the following detailed description with reference to the accompanying drawings, wherein.

Figure 1:
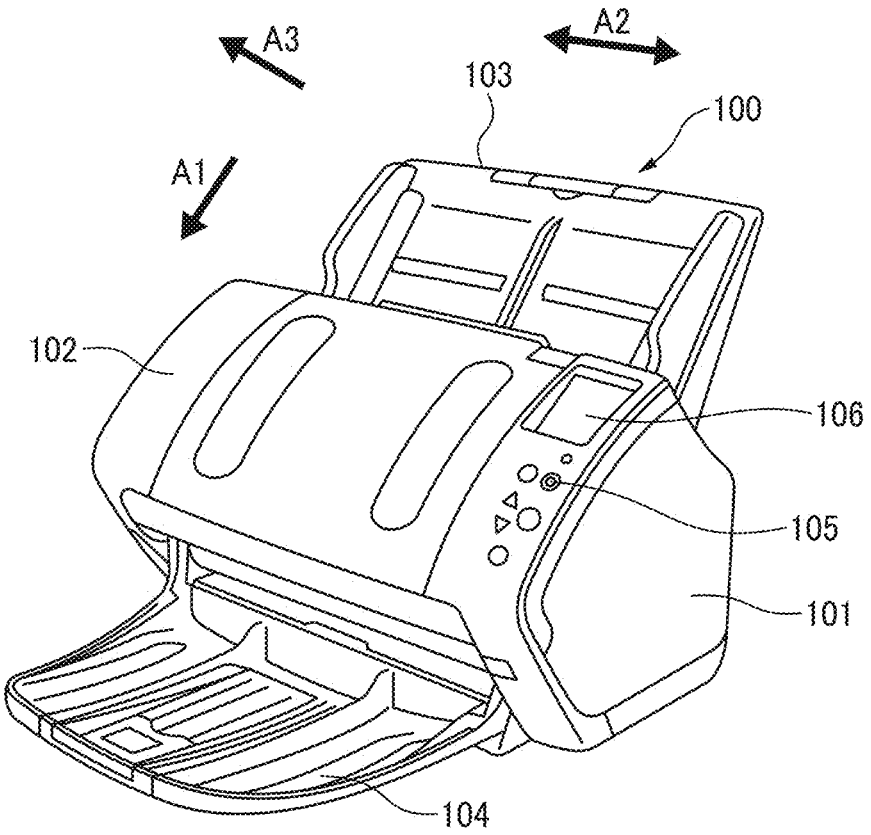
FIG. 1 is a perspective view of a media conveying apparatus according to an embodiment of the present disclosure.

The accompanying drawings are intended to depict embodiments of the present disclosure and should not be interpreted to limit the scope thereof. The accompanying drawings are not to be considered as drawn to scale unless explicitly noted. Also, identical or similar reference numerals designate identical or similar components throughout the several views.

DETAILED DESCRIPTION

In describing embodiments illustrated in the drawings, specific terminology is employed for the sake of clarity. However, the disclosure of this specification is not intended to be limited to the specific terminology so selected and it is to be understood that each specific element includes all technical equivalents that have a similar function, operate in a similar manner, and achieve a similar result.

Referring now to the drawings, embodiments of the present disclosure are described below. As used herein, the singular forms "a," "an," and "the" are intended to include the plural forms as well, unless the context clearly indicates otherwise.

The objects and advantages of the present disclosure are recognized and achieved by the elements particularly pointed out in the appended claims and the combinations thereof. It is to be understood that both the above-described general description and the detailed description described below are exemplary and explanatory only and are not intended to restrict the claimed invention.

A description is given below of a media conveying apparatus, a media conveying method, and a control program according to embodiments of the present disclosure, with reference to the drawings. However, the technical scope of the present disclosure is not limited to the embodiments described below but includes the scope of the appended claims and the equivalents thereof.

FIG. 1 is a perspective view of a media conveying apparatus 100 as an image scanner. The media conveying apparatus 100 conveys and images media that are documents. Examples of media include sheets of plain paper, sheets of thin paper, sheets of thick paper, cards, and booklets. The media conveying apparatus 100 may be a facsimile machine, a copier, or a multifunction peripheral (MFP) instead of an image scanner, etc. The media to be conveyed may be printing material (e.g., paper sheets) instead of documents. In this case, the media conveying apparatus 100 may be a printer.

The media conveying apparatus 100 includes a lower housing 101, an upper housing 102, a media table 103, an ejection table 104, an operation device 105, and a display device 106. In FIG. 1, arrow A1 indicates a media conveyance direction in which media are conveyed. Arrow A2 indicates a width direction orthogonal to the media conveyance direction. Arrow A3 indicates a height direction orthogonal to a media conveyance passage. In the following description, the media conveyance direction indicated by arrow A1, the width direction indicated by arrow A2, and the height direction indicated by arrow A3 are referred to as a media conveyance direction A1, a width direction A2, and a height direction A3, respectively. In the following description, the term "upstream" refers to upstream in the media conveyance direction A1 whereas the term "downstream" refers to downstream in the media conveyance direction A1.

The upper housing 102 is located at a position covering the upper face of the media conveying apparatus 100 and is hinged to the lower housing 101 such that the upper housing 102 can be opened and closed to remove a jammed medium or clean the inside of the media conveying apparatus 100, for example.

The media table 103 is engaged with the lower housing 101. Media to be fed and conveyed are placed on the media table 103. The ejection table 104 is engaged with the upper housing 102 and stack ejected media. The ejection table 104 may be engaged with the lower housing 101.

The operation device 105 includes an input device such as keys and an interface circuit that acquires signals from the input device. The operation device 105 receives an input operation performed by a user and outputs an operation signal corresponding to the input operation performed by the user. The display device 106 includes a display and an interface circuit that outputs image data to the display and displays the image data on the display. Examples of the display include a liquid crystal display (LCD) and an organic electro-luminescence display (OELD).

Figure 2:
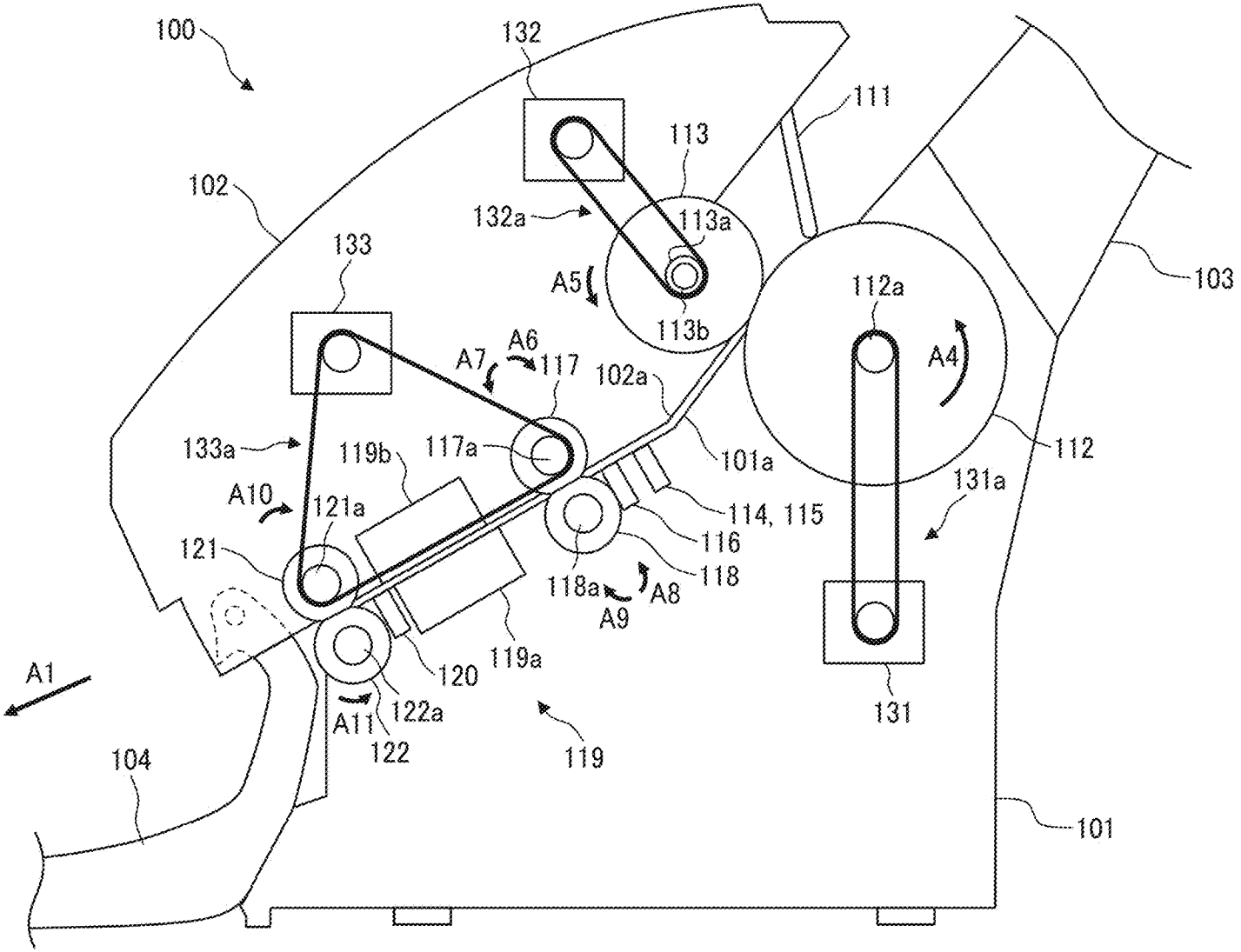
FIG. 2 is a diagram illustrating a conveyance passage inside the media conveying apparatus of FIG. 1.

FIG. 2 is a diagram illustrating a conveyance passage inside the media conveying apparatus 100.

The media conveying apparatus 100 includes a first media sensor 111, a feed roller 112, a separation roller 113, a second media sensor 114, a third media sensor 115, a fourth media sensor 116, a first conveyance roller 117, a first driven roller 118, an imaging device 119, a fifth media sensor 120, a second conveyance roller 121, and a second driven roller 122 along the conveyance passage.

The number of each of the feed roller 112, the separation roller 113, the first conveyance roller 117, the first driven roller 118, the second conveyance roller 121, and/or the second driven roller 122 is not limited to one and may be two or more. In this case, the two or more rollers of the feed rollers 112, the separation rollers 113, the first conveyance rollers 117, the first driven rollers 118, the second conveyance rollers 121, and/or the second driven rollers 122 are aligned and spaced apart in the width direction A2 orthogonal to the media conveyance direction A1.

The upper face of the lower housing 101 forms a lower guide 101*a* for the media conveyance passage. The lower face of the upper housing 102 forms an upper guide 102*a* for the media conveyance passage.

The first media sensor 111 is located upstream from the feed roller 112 and the separation roller 113. The first media sensor 111 includes a contact sensor and detects whether a medium is placed on the media table 103. The first media sensor 111 generates and outputs a first media signal whose signal value changes depending on whether a medium is placed on the media table 103. The first media sensor 111 is not limited to the contact sensor. The first media sensor 111 may be any other sensor that can detect the presence of a medium, such as an optical sensor.

The feed roller 112 is located in the lower housing 101. The feed roller 112 rotates in a media feeding direction A4 in which media are fed and sequentially separates and feeds the media on the media table 103 from the bottom. The separation roller 113 is a so-called brake roller or retard roller. The separation roller 113 is located in the upper housing 102 and faces the feed roller 112. The separation roller 113 is stoppable or rotatable in a direction A5 opposite to a media feeding direction in which media are fed. Alternatively, the feed roller 112 may be located in the upper housing 102 and the separation roller 113 may be located in the lower housing 101, and the feed roller 112 may feed the media on the media table 103 from the top.

The first conveyance roller 117 and the first driven roller 118 are located downstream from the feed roller 112 and the separation roller 113 in the media conveyance direction A1 and face each other. The first conveyance roller 117 is located in the upper housing 102 and conveys the medium fed by the feed roller 112 and the separation roller 113 to the imaging device 119. Alternatively, the first conveyance roller 117 may be located in the lower housing 101 and the first driven roller 118 may be located in the upper housing 102.

The first conveyance roller 117 rotates in a forward direction A6 and applies a force directing the medium downstream. Thus, the first conveyance roller 117 conveys the fed medium downstream in the media conveyance direction A1. On the other hand, the first conveyance roller 117 stops or rotates in a reverse direction A7 and applies a force directing the medium upstream. Thus, the first conveyance roller 117 stops the forward movement of the leading end of the fed medium to align the leading end of the medium. In other words, the first conveyance roller 117 functions as a registration roller that corrects the inclination of the leading end of the fed medium by stopping or rotating in the reverse direction A7. When the first conveyance roller 117 rotates in the forward direction A6, the first driven roller 118 is rotated in a forward direction A8 by the rotation of the first conveyance roller 117. When the first conveyance roller 117 rotates in the reverse direction A7, the first driven roller 118 is rotated in a reverse direction A9 by the rotation of the first conveyance roller 117.

The imaging device 119 is located downstream from the first conveyance roller 117 and upstream from the second conveyance roller 121 in the media conveyance direction A1. The imaging device 119 images the medium conveyed by the first conveyance roller 117 and the first driven roller 118. The imaging device 119 includes a first imaging device 119*a* and a second imaging device 119*b* facing each other across the media conveyance passage.

The first imaging device 119*a* includes a line sensor based on a unity-magnification optical system type contact image sensor (CIS) including complementary metal oxide semiconductor- (CMOS-) based imaging elements linearly arranged in a main scanning direction. The first imaging device 119*a* further includes lenses each forming an image on an imaging element, and an analog-to-digital (A/D) converter amplifying and A/D converting an electric signal output from the imaging element. The first imaging device 119*a* generates an input image by imaging the front side of a conveyed medium in accordance with control from a processing circuit to be described later and outputs the generated image.

Similarly, the second imaging device 119*b* includes a line sensor based on a unity-magnification optical system type CIS including CMOS-based imaging elements linearly arranged in the main scanning direction. The second imaging device 119*b* further includes lenses each forming an image on an imaging element, and an A/D converter amplifying and A/D converting an electric signal output from the imaging element. The second imaging device 119*b* generates an input image by imaging the back side of a conveyed medium in accordance with control from the processing circuit to be described later and outputs the generated image.

The media conveying apparatus 100 may include either the first imaging device 119*a* or the second imaging device 119*b* and read only one side of the medium. A line sensor based on a unity-magnification optical system type CIS including charge coupled device-(CCD-) based imaging elements may be used in place of the line sensor based on a unity-magnification optical system type CIS including CMOS-based imaging elements. A reduction optical system type line sensor including CMOS-based or CCD-based imaging elements may be used.

The second conveyance roller 121 and the second driven roller 122 are located downstream from the imaging device 119, that is, from the first conveyance roller 117 and the first driven roller 118 in the media conveyance direction A1 and face each other. The second conveyance roller 121 is located in the upper housing 102. The second conveyance roller 121 conveys the medium conveyed by the first conveyance roller 117 and the first driven roller 118 further downstream and ejects the medium to the ejection table 104. Alternatively, the second conveyance roller 121 may be located in the lower housing 101 and the second driven roller 122 may be located in the upper housing 102.

The second conveyance roller 121 rotates in a forward direction A10 and applies a force directing the medium downstream. Thus, the second conveyance roller 121 conveys the fed medium downstream in the media conveyance direction A1. When the second conveyance roller 121 rotates in the forward direction A10, the second driven roller 122 is rotated in a forward direction A11 by the rotation of the second conveyance roller 121.

As the feed roller 112 rotates in the media feeding direction A4, the medium is conveyed from the media table 103 in the media conveyance direction A1 between the lower guide 101*a* and the upper guide 102*a*. The media conveying apparatus 100 has two feeding modes: a separation mode in which media are fed while being separated and a non-separation mode in which media are fed without being separated. The feeding mode is set by a user using the operation device 105 or an information processing device communicably connected to the media conveying apparatus 100. When the feeding mode is set to the separation mode, the separation roller 113 rotates in the direction A5 opposite to the media feeding direction or stops. Due to the operations of the feed roller 112 and separation roller 113, only the medium in contact with the feed roller 112 among the multiple media placed on the media table 103 is separated. This prevents the feeding of a medium other than the separated medium. In other words, the multi-feed is prevented. When the feeding mode is set to the non-separation mode, the separation roller 113 rotates in the media feeding direction opposite to the direction A5.

The medium is fed to a nip formed by the first conveyance roller 117 and the first driven roller 118 while being guided by the lower guide 101*a* and the upper guide 102*a*. The first conveyance roller 117 and the first driven roller 118 rotate in the reverse directions A7 and A9, respectively, for a certain period of time to stop the leading end of the medium at the nip formed by the first conveyance roller 117 and the first driven roller 118. During this time, the medium is pushed by the feed roller 112. As a result, the leading end of the medium is aligned. Thereafter, as the first conveyance roller 117 and the first driven roller 118 rotate in the forward directions A6 and A8, respectively, the medium is fed between the first imaging device 119*a* and the second imaging device 119*b*. After the imaging device 119 reads the medium, the medium is ejected to the ejection table 104 as the second conveyance roller 121 and the second driven roller 122 rotate in the directions A10 and A11, respectively.

As illustrated in FIG. 2, the media conveying apparatus 100 includes a first motor 131, a second motor 132, and a third motor 133 as driving sources of the rollers.

The first motor 131 is located in the lower housing 101. The first motor 131 is coupled to the feed roller 112 via a first transmission assembly 131*a* and drives the feed roller 112. The first motor 131 generates a driving force for rotating the feed roller 112 according to a control signal from the processing circuit so that the feed roller 112 feeds a medium. Alternatively, the first motor 131 may be located in the upper housing 102.

The first transmission assembly 131*a* includes one or more pulleys, belts, and gears between the first motor 131 and a shaft 112*a* serving as a rotary shaft of the feed roller 112. The first transmission assembly 131*a* transmits the driving force generated by the first motor 131 to the feed roller 112.

The second motor 132 is located in the upper housing 102 separately from the first motor 131. The second motor 132 is coupled to the separation roller 113 via a second transmission assembly 132*a* and drives the separation roller 113. The second motor 132 generates a driving force for rotating the separation roller 113 according to a control signal from the processing circuit so that the separation roller 113 separates, feeds, and conveys a medium. Alternatively, the second motor 132 may be located in the lower housing 101.

The second transmission assembly 132*a* includes one or more pulleys, belts, and gears between the second motor 132 and a shaft 113*a* serving as a rotary shaft of the separation roller 113. The second transmission assembly 132*a* transmits the driving force generated by the second motor 132 to the separation roller 113.

The media conveying apparatus 100 further includes a torque limiter 113*b*. The torque limiter 113*b* is located between the second motor 132 and the separation roller 113. In the example illustrated in FIG. 2, the torque limiter 113*b* is located on the shaft 113*a* serving as the rotary shaft of the separation roller 113. The torque limiter 113*b* defines a limit value of the torque applied to the separation roller 113. The limit value of the torque limiter 113*b* is set to prevent the rotational force from being transmitted through the torque limiter 113*b* when a single medium is conveyed, and to transmit the rotational force through the torque limiter 113*b* when multiple media are conveyed. As a result, when a single medium is conveyed, the separation roller 113 is rotated by the rotation of the feed roller 112, without being rotated by the driving force from the second motor 132. When multiple media are conveyed, the separation roller 113 rotates in the direction A5 opposite to the media feeding direction and separates the medium in contact with the feed roller 112 from the other media to prevent the occurrence of multi-feed. At this time, alternatively, the outer circumferential surface of the separation roller 113 that is stopped without rotating in the direction A5 opposite to the media feeding direction may apply a force in the direction A5 opposite to the media feeding direction to the media.

The third motor 133 is an example of a motor. The third motor 133 is located in the upper housing 102 separately from the first motor 131 and the second motor 132. The third motor 133 is coupled to the first conveyance roller 117 and the second conveyance roller 121 via a third transmission assembly 133*a* and drives the first conveyance roller 117 and the second conveyance roller 121 simultaneously. The third motor 133 generates a driving force for rotating the first conveyance roller 117 and the second conveyance roller 121 according to a control signal from the processing circuit so that the first conveyance roller 117 and the second conveyance roller 121 convey and eject a medium. Alternatively, the third motor 133 may be located in the lower housing 101.

The third transmission assembly 133*a* includes one or more pulleys, belts, and gears between the third motor 133, a shaft 117*a* serving as a rotary shaft of the first conveyance roller 117, and a shaft 121*a* serving as a rotary shaft of the second conveyance roller 121. The third transmission assembly 133*a* transmits the driving force generated by the third motor 133 to the first conveyance roller 117 and the second conveyance roller 121.

As described above, the media conveying apparatus 100 includes the third motor 133 as a common motor for driving the first conveyance roller 117 and driving the second conveyance roller 121. Accordingly, the media conveying apparatus 100 can reduce the number of motors and reduce the cost, size, and weight of the media conveying apparatus 100.

The first driven roller 118 is a driven roller rotated by the rotation of the first conveyance roller 117. The second driven roller 122 is a driven roller rotated by the rotation of the second conveyance roller 121. Alternatively, the first driven roller 118 and/or the second driven roller 122 may be driven by the driving force from the third motor 133. In this case, one or more gears are further located between the shaft 117*a* of the first conveyance roller 117 and a shaft 118*a* serving as a rotary shaft of the first driven roller 118 and/or between the shaft 121*a* of the second conveyance roller 121 and a shaft 122*a* serving as a rotary shaft of the second driven roller 122. The third transmission assembly 133*a* further transmits the driving force generated by the third motor 133 to the first driven roller 118 and/or the second driven roller 122.

Figure 3:
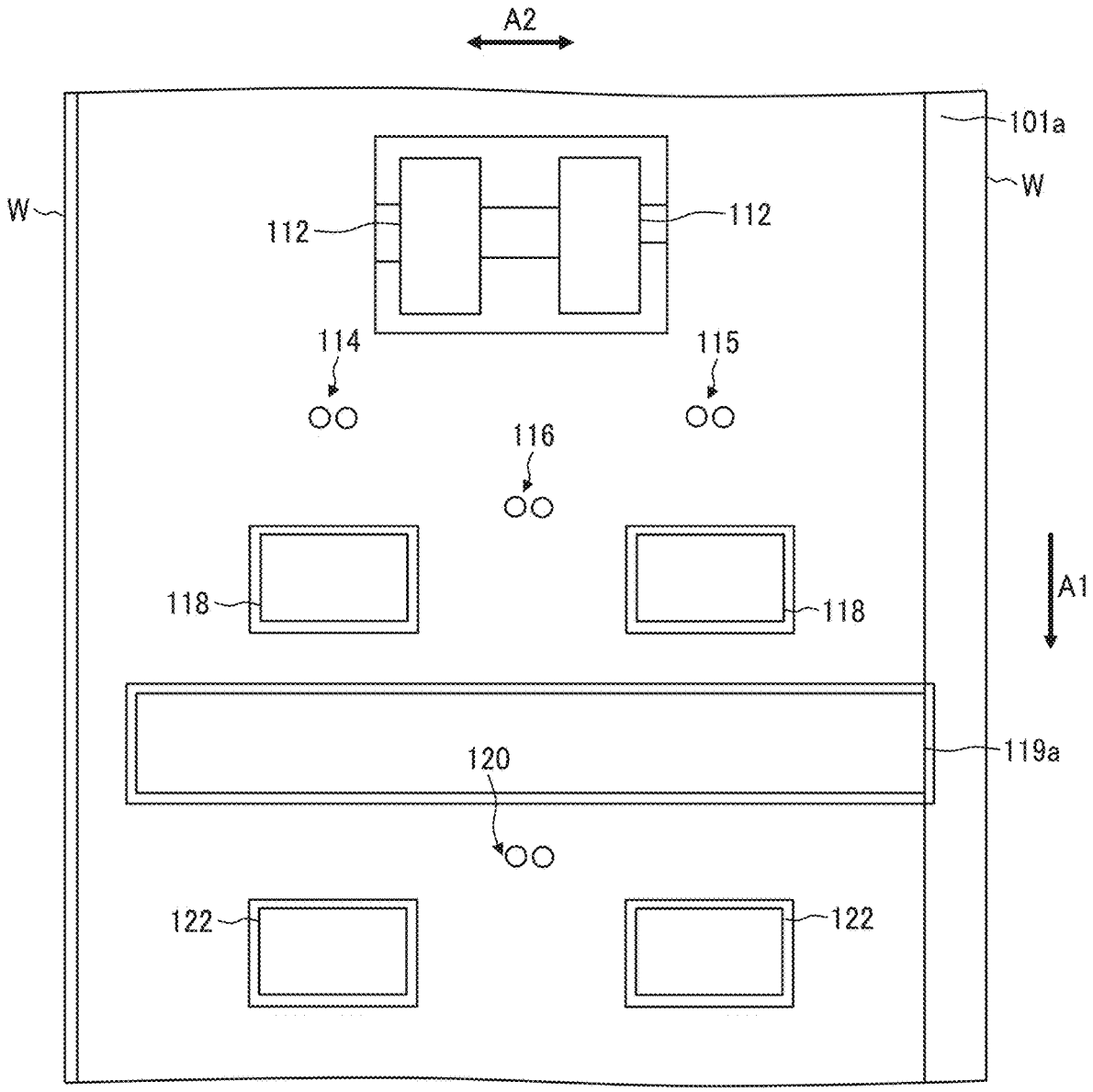
FIG. 3 is a schematic diagram illustrating a second media sensor and other sensors.

FIG. 3 is a schematic diagram illustrating the second media sensor 114, the third media sensor 115, the fourth media sensor 116, and the fifth media sensor 120. Specifically, FIG. 3 is a top view of the lower housing 101 while the upper housing 102 is opened.

In the example illustrated in FIG. 3, the two feed rollers 112, the two separation rollers 113, the two first conveyance rollers 117, the two first driven rollers 118, the two second conveyance rollers 121, and the two second driven rollers 122 are provided.

The second media sensor 114 and the third media sensor 115 are located downstream from the feed roller 112 and upstream from the first conveyance roller 117, that is, upstream from the imaging device 119 in the media conveyance direction A1. In particular, the second media sensor 114 and the third media sensor 115 are located upstream from the fourth media sensor 116. The second media sensor 114 and the third media sensor 115 are aligned and spaced apart from each other in the width direction A2. Specifically, each of the second media sensor 114 and the third media sensor 115 is located outside the fourth media sensor 116, particularly, outside the two feed rollers 112 in the width direction A2. In other words, the second media sensor 114 and the third media sensor 115 are closer to side walls W of the media conveyance passage than the fourth media sensor 116 (the feed rollers 112). The second media sensor 114 and the third media sensor 115 detect the medium conveyed to the respective positions of the second media sensor 114 and the third media sensor 115.

The second media sensor 114 includes a light emitter, a light receiver, and a light guide. The light emitter and the light receiver are located on one side of the media conveyance passage. The light guide faces the light emitter and the light receiver across the media conveyance passage. The light emitter is, e.g., a light emitting diode (LED) and emits light toward the media conveyance passage. The light receiver is, e.g., a photodiode and receives light that is emitted by the light emitter and guided by the light guide. When a medium faces the second media sensor 114, the light emitted from the light emitter is blocked by the medium, and therefore, the light receiver does not detect the light emitted from the light emitter. Based on the intensity of the light received by the light receiver, the second media sensor 114 generates and outputs a second media signal whose signal value changes depending on whether a medium is present at the position of the second media sensor 114.

The third media sensor 115 includes a light emitter, a light receiver, and a light guide. The light emitter and the light receiver are located on one side of the media conveyance passage. The light guide faces the light emitter and the light receiver across the media conveyance passage. The light emitter is, e.g., an LED and emits light toward the media conveyance passage. The light receiver is, e.g., a photodiode and receives light that is emitted by the light emitter and guided by the light guide. When a medium faces the third media sensor 115, the light emitted from the light emitter is blocked by the medium, and therefore, the light receiver does not detect the light emitted from the light emitter. Based on the intensity of the light received by the light receiver, the third media sensor 115 generates and outputs a third media signal whose signal value changes depending on whether a medium is present at the position of the third media sensor 115.

The fourth media sensor 116 is an example of a sensor. The fourth media sensor 116 is located downstream from the feed roller 112 and upstream from the first conveyance roller 117, that is, upstream from the imaging device 119 in the media conveyance direction A1. The fourth media sensor 116 is located at the center, particularly between the two feed rollers 112, between the two first conveyance rollers 117, and/or between the two second conveyance rollers 121 in the width direction A2. The fourth media sensor 116 is preferably located at the center position between the two first conveyance rollers 117 in the width direction A2. The fourth media sensor 116 detects the medium conveyed to the position of the fourth media sensor 116.

The fourth media sensor 116 includes a light emitter, a light receiver, and a light guide. The light emitter and the light receiver are located on one side of the media conveyance passage. The light guide faces the light emitter and the light receiver across the media conveyance passage. The light emitter is, e.g., an LED and emits light toward the media conveyance passage. The light receiver is, e.g., a photodiode and receives light that is emitted by the light emitter and guided by the light guide. Based on the intensity of the light received by the light receiver, the fourth media sensor 116 generates and outputs a fourth media signal whose signal value changes depending on whether a medium is present at the position of the fourth media sensor 116.

The fifth media sensor 120 is an example of another sensor. The fifth media sensor 120 is located downstream from the imaging device 119 and upstream from the second conveyance roller 121 in the media conveyance direction A1. The fifth media sensor 120 is located at the center, particularly between the two feed rollers 112, between the two first conveyance rollers 117, and/or between the two second conveyance rollers 121 in the width direction A2. The fifth media sensor 120 is preferably located at the center position between the two second conveyance rollers 121 in the width direction A2. The fifth media sensor 120 detects the medium conveyed to the position of the fifth media sensor 120.

The fifth media sensor 120 includes a light emitter, a light receiver, and a light guide. The light emitter and the light receiver are located on one side of the media conveyance passage. The light guide faces the light emitter and the light receiver across the media conveyance passage. The light emitter is, e.g., an LED and emits light toward the media conveyance passage. The light receiver is, e.g., a photodiode and receives light that is emitted by the light emitter and guided by the light guide. Based on the intensity of the light received by the light receiver, the fifth media sensor 120 generates and outputs a fifth media signal whose signal value changes depending on whether a medium is present at the position of the fifth media sensor 120. The fifth media signal is an example of an output signal from the second sensor.

In the second media sensor 114, the third media sensor 115, the fourth media sensor 116, and/or the fifth media sensor 120, a reflector such as a mirror may be used instead of the light guide. In the second media sensor 114, the third media sensor 115, the fourth media sensor 116, and/or the fifth media sensor 120, the light emitter and the light receiver may face each other across the media conveyance passage. Further, the second media sensor 114, the third media sensor 115, the fourth media sensor 116, and/or the fifth media sensor 120 may detect the presence of a medium with, e.g., a contact sensor that causes a predetermined current to flow when a medium is in contact with the contact sensor or when no medium is in contact with the contact sensor.

Figure 4:
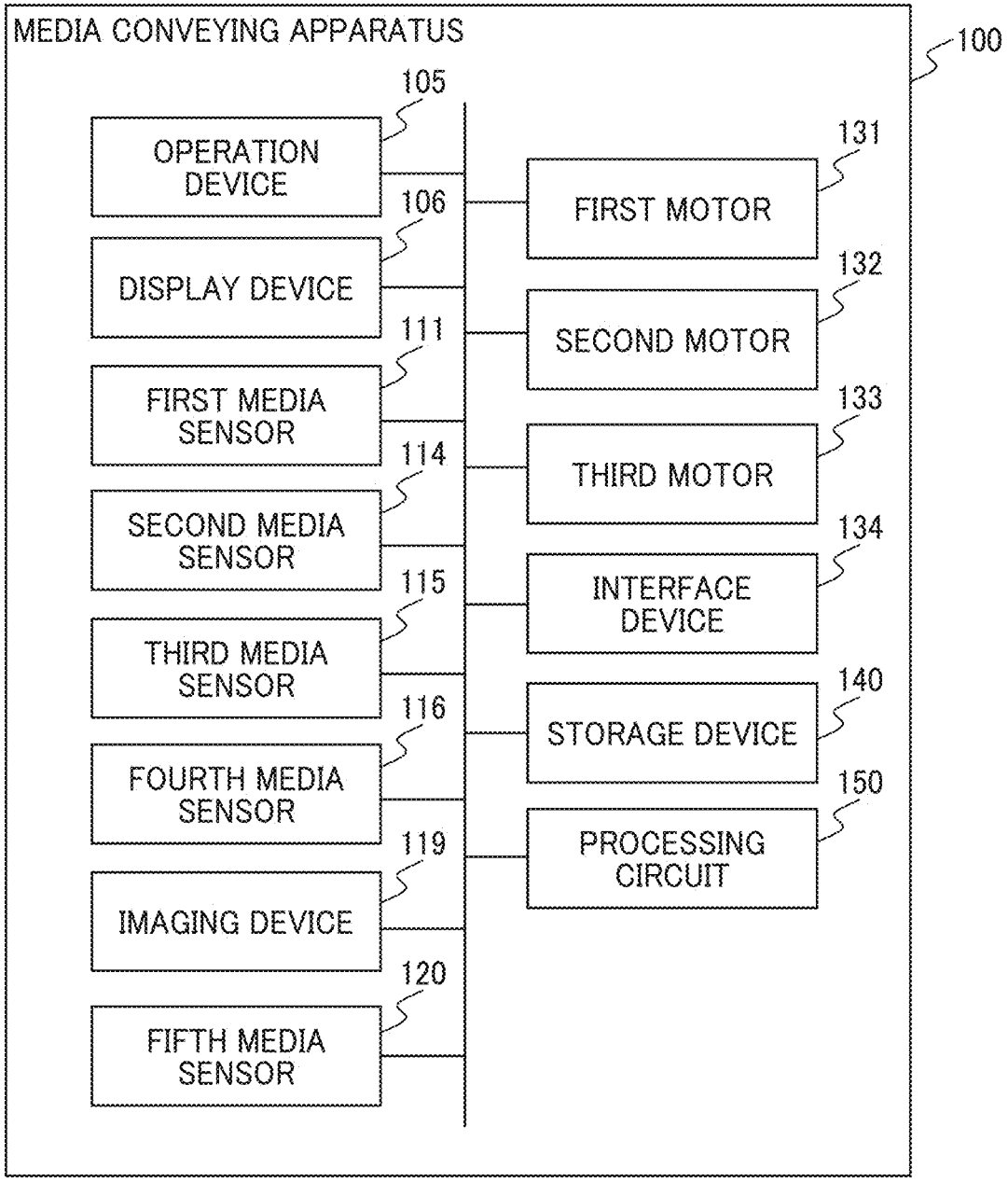
FIG. 4 is a schematic block diagram illustrating a configuration of the media conveying apparatus of FIG. 1.

FIG. 4 is a schematic block diagram illustrating a configuration of the media conveying apparatus 100.

The media conveying apparatus 100 further includes an interface device 134, a storage device 140, and a processing circuit 150, in addition to the configuration described above.

The interface device 134 includes an interface circuit compatible with a serial bus such as a universal serial bus (USB) and is electrically connected to an information processing device (e.g., a personal computer or a mobile information processing terminal) to transmit and receive an input image and various kinds of information to and from the information processing device. The interface device 134 may be substituted by a communication unit including an antenna to transmit and receive wireless signals and a wireless communication interface device to transmit and receive the signals through a wireless communication line according to a predetermined communication protocol. The predetermined communication protocol is, e.g., a wireless local area network (LAN) communication protocol. The communication unit may include a wired communication interface device to transmit and receive signals through a wired communication line according to communication protocol such as a wired LAN communication protocol.

The storage device 140 includes memories such as a random-access memory (RAM) and a read-only memory (ROM); a fixed disk device such as a hard disk; or a portable memory such as a flexible disk or an optical disk. The storage device 140 stores, e.g., computer programs, databases, and tables used for various processes performed by the media conveying apparatus 100. The computer programs may be installed in the storage device 140 from a computer-readable portable recording medium using, e.g., a known setup program. Examples of the portable recording medium include a compact disc read-only memory (CD-ROM) and a digital versatile disc read-only memory (DVD-ROM).

The processing circuit 150 operates according to a program prestored in the storage device 140. The processing circuit 150 is, e.g., a central processing unit (CPU). Alternatively, e.g., a digital signal processor (DSP), a large-scale integration (LSI), an application-specific integrated circuit (ASIC), or a field-programmable gate array (FPGA) may be used as the processing circuit 150.

The processing circuit 150 is connected to, e.g., the operation device 105, the display device 106, the first media sensor 111, the second media sensor 114, the third media sensor 115, the fourth media sensor 116, the imaging device 119, the fifth media sensor 120, the first motor 131, the second motor 132, the third motor 133, the interface device 134, and the storage device 140, and controls these components. The processing circuit 150 controls, e.g., the driving of the motors and the imaging by the imaging device 119 based on the media signals received from the media sensors. The processing circuit 150 acquires an input image from the imaging device 119 and transmits the input image to the information processing device via the interface device 134. The processing circuit 150 also executes the alignment of the leading end of a conveyed medium based on the media signals received from the media sensors.

Figure 5:
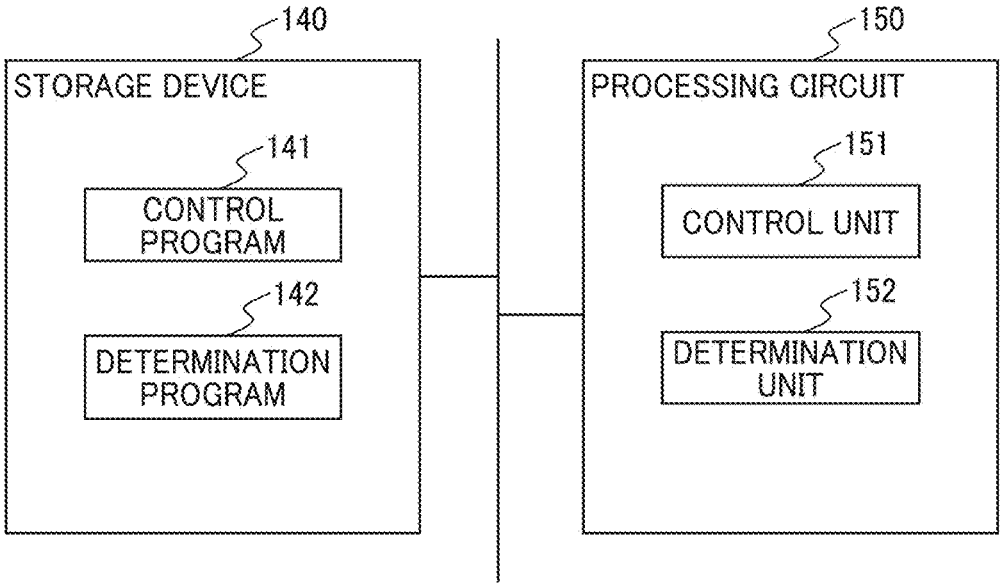
FIG. 5 is a schematic block diagram illustrating a configuration of a storage device and a processing circuit of the media conveying apparatus of FIG. 1.

FIG. 5 is a schematic block diagram illustrating a configuration of the storage device 140 and the processing circuit 150.

As illustrated in FIG. 5, the storage device 140 stores, e.g., a control program 141 and a determination program 142. These programs are functional modules implemented by software operating on the processor. The processing circuit 150 reads the programs from the storage device 140 and operates according to the read programs. Thus, the processing circuit 150 functions as a control unit 151 and a determination unit 152.

Figure 6:
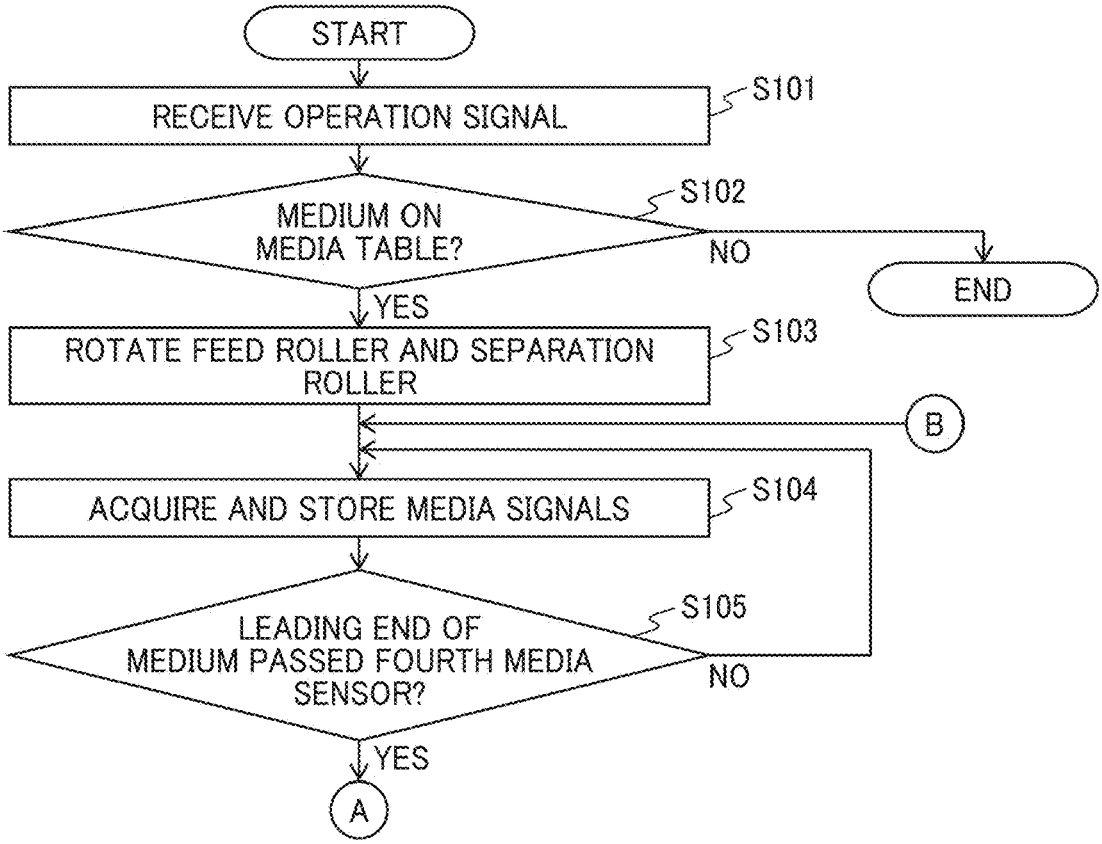
FIG. 6 is a flowchart of an example of a media conveying process.
Figure 7:
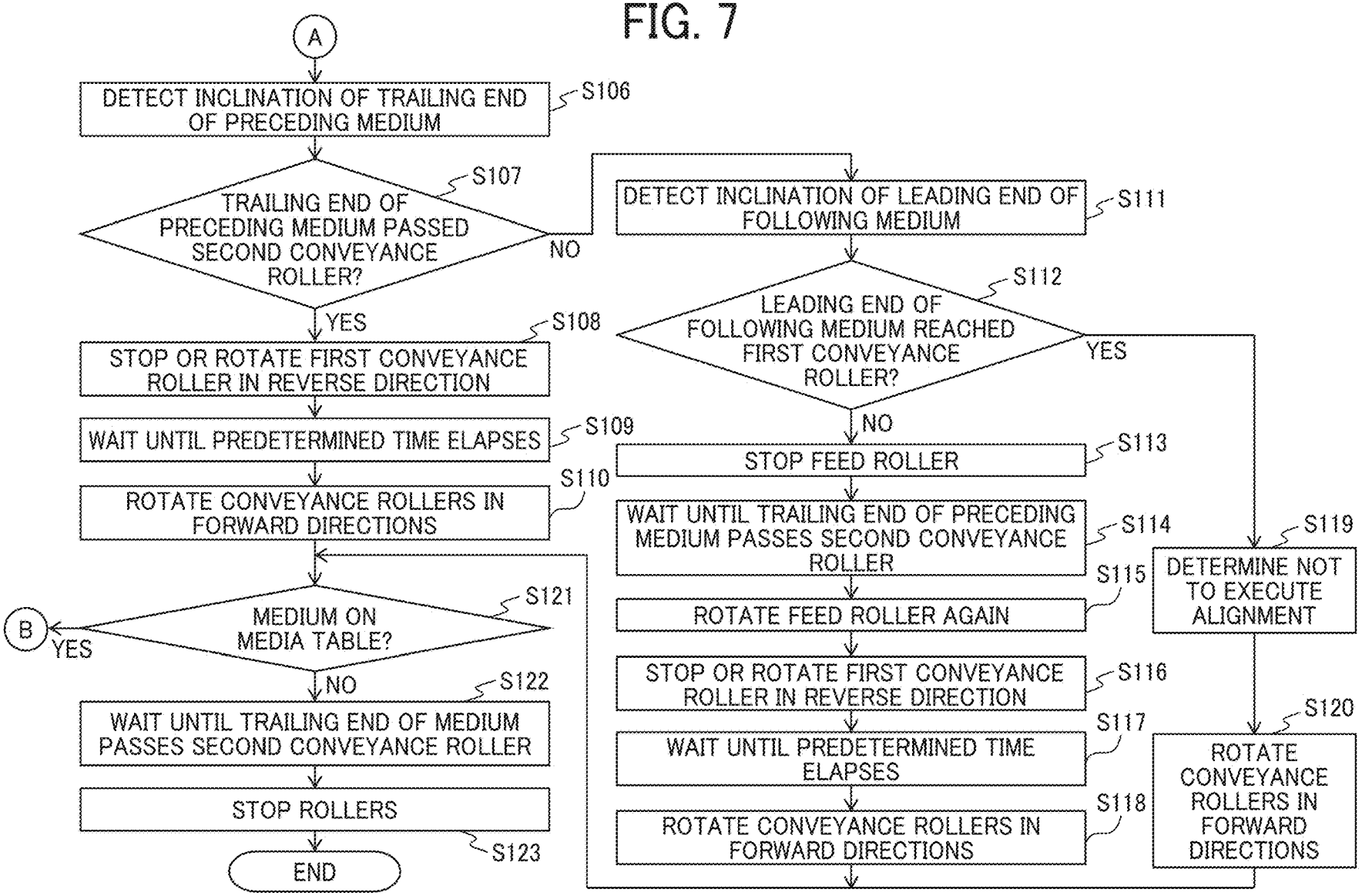
FIG. 7 is a continuation of the flowchart of FIG. 6.

FIG. 6 is a flowchart of an example of a media conveying process performed by the media conveying apparatus 100. FIG. 7 is a continuation of the flowchart of FIG. 6.

A description is given below of an example of the media conveying process performed by the media conveying apparatus 100, with reference to the flowchart of FIGS. 6 and 7. The sequence of operations described below is executed by, e.g., the processing circuit 150 in cooperation with the components of the media conveying apparatus 100 based on the program prestored in the storage device 140.

In step S101, the control unit 151 waits until the control unit 151 receives an operation signal instructing the reading of media from the operation device 105 or the interface device 134. The operation signal is output when the user inputs an instruction to read media using the operation device 105 or the information processing device.

In step S102, the control unit 151 acquires the first media signal from the first media sensor 111 and determines whether a medium is placed on the media table 103 based on the acquired first media signal. When no medium is placed on the media table 103 (NO in step S102), the control unit 151 ends the series of steps.

By contrast, when a medium is placed on the media table 103 (YES in step S102), in step S103, the control unit 151 drives the first motor 131 and the second motor 132 to rotate the feed roller 112 and the separation roller 113, respectively, to feed the medium. The control unit 151 rotates the feed roller 112 in the media feeding direction A4 and rotates the separation roller 113 in the direction A5 opposite to the media feeding direction.

In step S104, the determination unit 152 acquires the second media signal, the third media signal, the fourth media signal, and the fifth media signal from the second media sensor 114, the third media sensor 115, the fourth media sensor 116, and the fifth media sensor 120, respectively. The determination unit 152 stores the acquired media signals in the storage device 140 in association with the time of acquisition.

In step S105, the control unit 151 determines whether the leading end of the medium being fed has passed the position of the fourth media sensor 116 based on the fourth media signal. When the signal value of the fourth media signal changes from a value indicating the absence of a medium to a value indicating the presence of a medium, the control unit 151 determines that the leading end of the medium has passed the position of the fourth media sensor 116. When the leading end of the medium being fed has not passed the position of the fourth media sensor 116 (NO in step S105), the control unit 151 returns the process to step S104 and repeats the process from step S104 to step S105.

By contrast, when the leading end of the medium being fed has passed the position of the fourth media sensor 116 (YES in step S105), in step S106, the determination unit 152 detects the inclination of the trailing end of a preceding medium that is fed immediately before the medium being fed and precedes the medium being fed. The medium being fed, that is, the following medium following the preceding medium is an example of a first medium. The preceding medium is an example of a second medium. When the medium being currently fed is a medium that is fed first among the media collectively placed on the media table 103, no preceding medium is present. Therefore, the control unit 151 does not execute the process from step S106 to step S107 and proceeds with the process to step S108.

The determination unit 152 detects the inclination of the trailing end of the preceding medium, for example, based on the second media signal and the third media signal stored in the storage device 140. The determination unit 152 detects the latest time at which the signal value of the second media signal changes from a value indicating the presence of a medium to a value indicating the absence of a medium as the time at which the trailing end of the preceding medium passes the position of the second media sensor 114. Similarly, the determination unit 152 detects the latest time at which the signal value of the third media signal changes from a value indicating the presence of a medium to a value indicating the absence of a medium as the time at which the trailing end of the preceding medium passes the position of the third media sensor 115. The determination unit 152 calculates an inclination θ1 of the trailing end of the preceding medium using the following Equation (1).

$$\theta 1 = \tan^{-1}(T1 \times V1/W0) \tag{1}$$

In Equation (1), T1 represents a time difference between the time when the trailing end of the preceding medium passes the position of the second media sensor 114 and the time when the trailing end of the preceding medium passes the position of the third media sensor 115. V1 represents the conveyance speed of the preceding medium. In other words, (T1×V1) indicates the difference in the distance in the media conveyance direction A1 between the trailing end of the preceding medium at the position of the second media sensor 114 and the trailing end of the preceding medium at the position of the third media sensor 115. W0 represents the distance between the second media sensor 114 and the third media sensor 115 in the width direction A2.

The determination unit 152 may detect the inclination of the trailing end of the preceding medium from an input image of the imaged preceding medium by using a known image processing technique. In this case, for each vertical line extending in the vertical direction (sub-scanning direction) in the input image of the imaged preceding medium, the determination unit 152 calculates an absolute value of a difference in gradation value (hereinafter, referred to as an adjacent difference value) between a pixel and pixels adjacent to the pixel in the vertical direction in each vertical line. The determination unit 152 detects a pixel whose adjacent difference value exceeds a gradation threshold as an edge pixel in each vertical line and detects an edge pixel located at the bottom among the detected edge pixels as a lower-end edge pixel. The gradation value is, e.g., a brightness value or a color value such as a red (R) value, a green (G) value, or a blue (B) value. The gradation threshold is set to, e.g., a difference in the brightness value (e.g., 20) at which a person can visually distinguish the difference in brightness on an image.

The determination unit 152 may calculate, as the adjacent difference value, an absolute value of the difference in the gradation value between two pixels that are separated from each pixel in the input image by a predetermined distance in the vertical direction. The determination unit 152 may detect an edge pixel by comparing the gradation value of each pixel in the input image with a threshold. For example, when the gradation value of a particular pixel is less than the threshold and the gradation value of a pixel adjacent to the particular pixel in the vertical direction or a pixel apart from the particular pixel by the predetermined distance in the vertical direction is equal to or greater than the threshold, the determination unit 152 detects the particular pixel as the edge pixel.

The determination unit 152 detects a straight line from the lower-end edge pixel using the least squares method. Alternatively, the determination unit 152 may detect the straight line using the Hough transform. The determination unit 152 detects the inclination of the detected straight line with respect to a horizontal line extending in the horizontal direction (main scanning direction) in the input image as the inclination of the trailing end of the preceding medium.

In step S107, the determination unit 152 determines whether the trailing end of the preceding medium has passed the second conveyance roller 121.

The determination unit 152 determines whether the signal value of the fifth media signal has changed from a value indicating the absence of a medium (OFF) to a value indicating the presence of a medium (ON) after the feeding of the preceding medium has started. When the signal value of the fifth media signal has not changed from OFF to ON after the feeding of the preceding medium has started, the determination unit 152 determines that the leading end of the preceding medium has not passed the position of the fifth media sensor 120 and the trailing end of the preceding medium has not passed the second conveyance roller 121. By contrast, when the signal value of the fifth media signal has changed from OFF to ON after the feeding of the preceding medium has started, the determination unit 152 further determines whether the signal value of the fifth media signal has changed to OFF again. When the signal value of the fifth media signal has not been changed to OFF again, the determination unit 152 determines that the trailing end of the preceding medium has not passed the position of the fifth media sensor 120 and the trailing end of the preceding medium has not passed the second conveyance roller 121.

By contrast, when the signal value of the fifth media signal has changed from OFF to ON after the feeding of the preceding medium has started and then changed to OFF again, the determination unit 152 determines that the trailing end of the preceding medium has passed the position of the fifth media sensor 120. In this case, the determination unit 152 calculates a first distance, which is the distance by which the trailing end of the preceding medium has moved forward from the position of the fifth media sensor 120.

Figure 8:
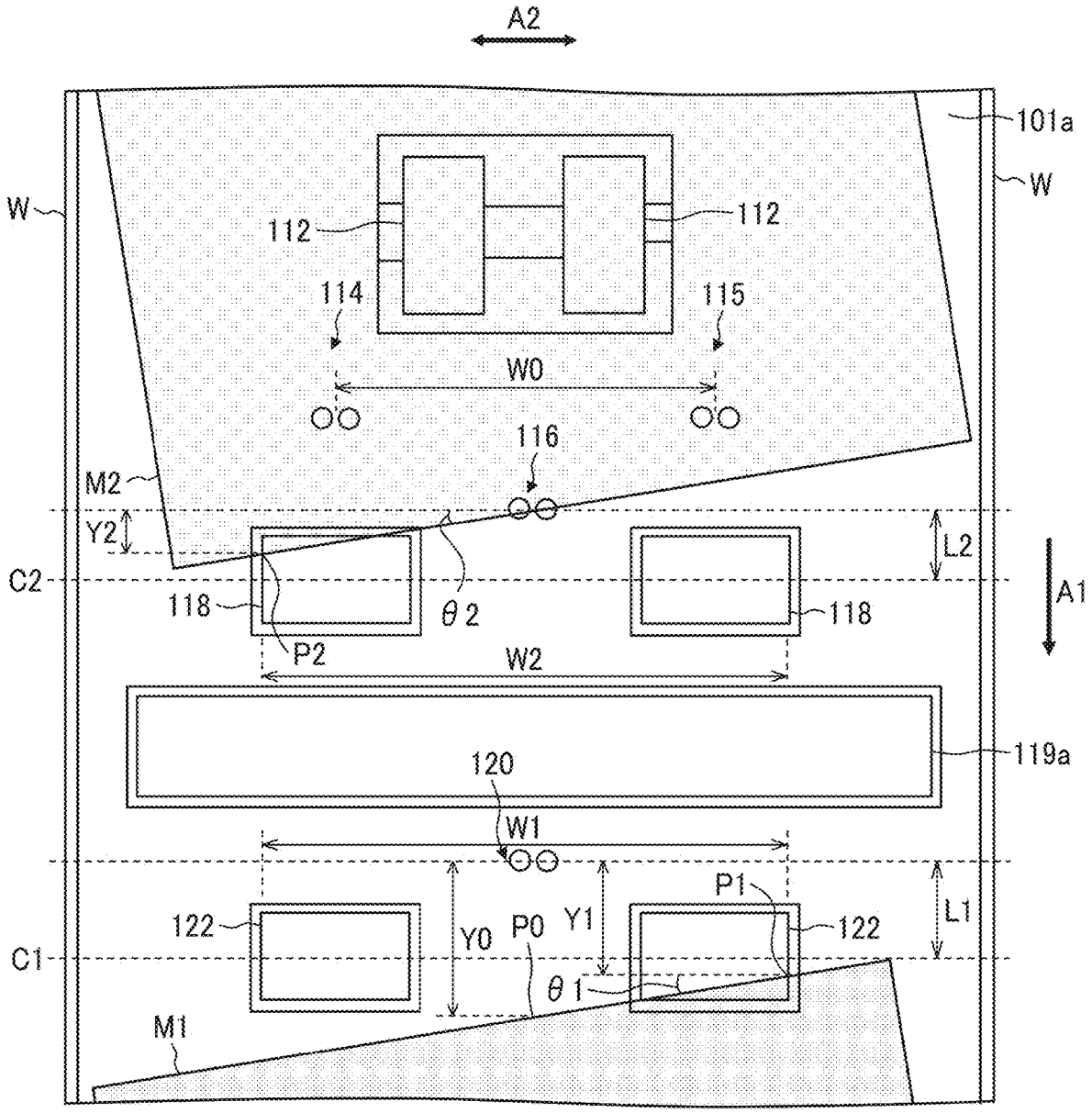
FIG. 8 is a schematic diagram illustrating the relative positions of media and sensors.

FIG. 8 is a schematic diagram illustrating the relative positions of conveyed media, the rollers, and the media sensors. FIG. 8 is a top view of the lower housing 101 with the upper housing 102 being opened.

FIG. 8 illustrates an example in which a preceding medium M1 and a following medium M2 are conveyed in an inclined manner with the left side leading and the right side lagging.

The determination unit 152 calculates a first distance Y1 using the following Equation (2). The first distance Y1 is the distance by which the trailing end of the preceding medium has moved from the position of the fifth media sensor 120 to a position P1. The position P1 is the outer end in the width direction A2 of the nip portion formed by the second conveyance roller 121 and the second driven roller 122 located on the same side as the lagging side of the preceding medium. In the following description, the nip formed by the second conveyance roller 121 and the second driven roller 122 may be referred to as an ejection area.

$$Y1 = Y0 - (W1/2) \times \tan \theta 1 \tag{2}$$

In Equation (2), Y0 represents the distance by which the trailing end of the preceding medium has moved from the position of the fifth media sensor 120 in the media conveyance direction A1 at a position P0 where the fifth media sensor 120 is located in the width direction A2. Y0 is calculated by multiplying the elapsed time from when the trailing end of the preceding medium passes the position of the fifth media sensor 120 to the present time by a conveyance speed V1 of the preceding medium. W1 represents the distance between the outer end of the nip formed by the second conveyance roller 121 and the second driven roller 122 and the outer end of the nip formed by the other second conveyance rollers 121 and the other second driven roller 122 in the width direction A2.

When the first distance Y1 is greater than a distance L1 between the fifth media sensor 120 and a predetermined position C1 of the ejection area in the media conveyance direction A1, the determination unit 152 determines that the trailing end of the preceding medium has passed the second conveyance roller 121. The predetermined position C1 is set, for example, at the center position of the ejection area. Alternatively, the predetermined position C1 may be set at a position where a straight line passing through the rotation center of the second conveyance roller 121 and the rotation center of the second driven roller 122 intersects with the ejection area. Alternatively, the predetermined position C1 may be set at a downstream end position of the ejection area. By contrast, when the first distance Y1 is equal to or less than the distance L1, the determination unit 152 determines that the trailing end of the preceding medium has not passed the second conveyance roller 121.

In this way, the determination unit 152 determines whether the trailing end of the medium has passed the second conveyance roller 121 based on the detected inclination of the trailing end of the medium and the fifth media signal from the fifth media sensor 120. Accordingly, the determination unit 152 can determine whether the trailing end of the medium has passed the second conveyance roller 121 with high accuracy.

The determination unit 152 may determine whether the trailing end of the medium has passed the second conveyance roller 121, without considering the inclination of the trailing end of the medium. In this case, the determination unit 152 calculates the distance Y0 as the first distance YL. The distance Y0 is the distance by which the trailing end of the preceding medium has moved in the media conveyance direction A1 from the position P0, where the fifth media sensor 120 is located in the width direction A2.

When the distance Y0 is greater than a predetermined distance threshold, the determination unit 152 may determine that the trailing end of the medium has passed the second conveyance roller 121. The distance threshold is set to a distance at which the trailing end of the medium conveyed while being inclined by the maximum angle allowed for the media conveying apparatus 100 to not to contact the ejection area.

The determination unit 152 may determine whether the trailing end of the medium has passed the second conveyance roller 121 using the fourth media signal from the fourth media sensor 116 instead of the fifth media signal from the fifth media sensor 120.

When the determination unit 152 determines that the trailing end of the preceding medium has passed the second conveyance roller 121 (YES in step S107), in step S108, the control unit 151 controls the third motor 133 to stop the first conveyance roller 117 or rotate the first conveyance roller 117 in the reverse direction A7. When the first conveyance roller 117 rotates in the reverse direction A7, the first driven roller 118 is rotated in the reverse direction A9 by the rotation of the first conveyance roller 117. When the first conveyance roller 117 stops, the first driven roller 118 stops together with the first conveyance roller 117. When the aligning of the leading end of the medium is being executed by stopping the first conveyance roller 117, the operation in step S108 may be omitted when the first conveyance roller 117 is being stopped.

In step S109, the control unit 151 waits until a predetermined time elapses to align the leading end of the medium at the position of the first conveyance roller 117. The predetermined time is set to a maximum value or an average value of time it takes for the inclination of a medium to be corrected (eliminated) by the medium being blocked by the first conveyance roller 117 and the first driven roller 118 in experiments in which various types of media are fed while being inclined at various angles.

Figure 9:
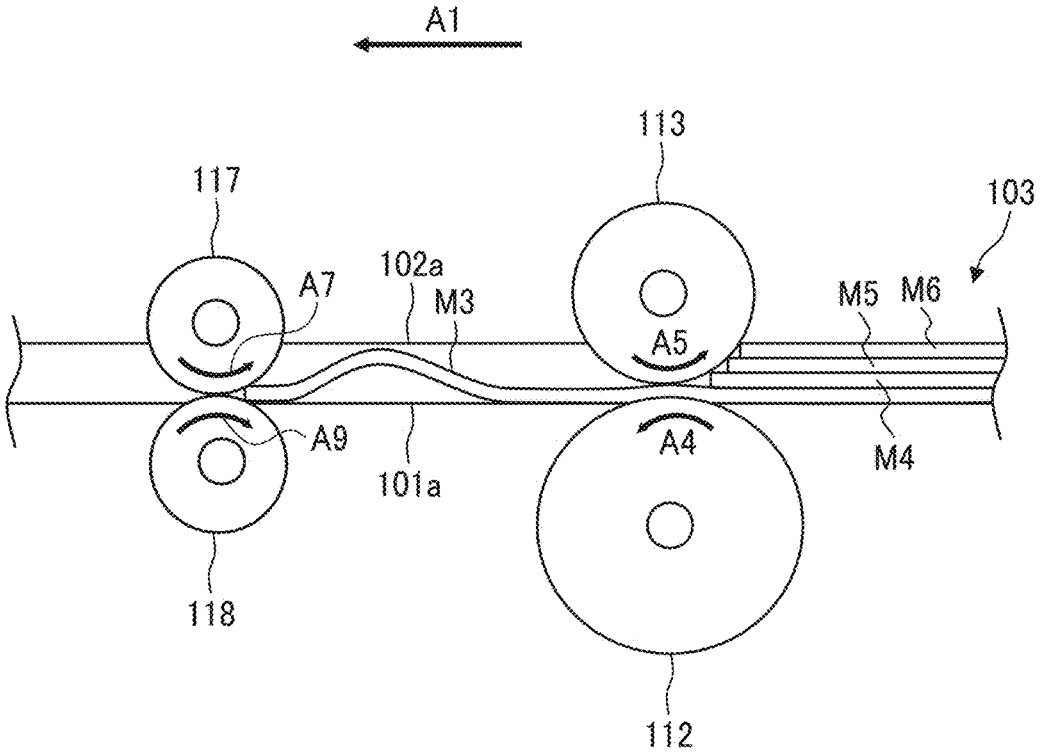
FIG. 9 is a schematic diagram illustrating the alignment of the leading end of a medium.

FIG. 9 is a schematic diagram illustrating the alignment of the leading end of a medium.

In the example illustrated in FIG. 9, multiple media M3 to M6 are collectively placed on the media table 103. As illustrated in FIG. 9, only the medium M3 in contact with the feed roller 112 is separated and fed among the media M3 to M6 placed on the media table 103 and reaches the nip formed by the first conveyance roller 117 and the first driven roller 118. At this time, as the first conveyance roller 117 and the first driven roller 118 stop or rotate in the reverse directions A7 and A9, respectively, the forward movement of the leading end of the medium M3 is stopped by the first conveyance roller 117 and the first driven roller 118. Meanwhile, the feed roller 112 is controlled to rotate in the media feeding direction A4 in step S103 and keep pushing the medium M3 downstream, so that the medium M3 is pushed downstream while bending upward. Thus, the leading end of the medium M3 fed in an inclined manner with respect to the width direction A2 is aligned in the width direction A2 at the nip formed by the first conveyance roller 117 and the first driven roller 118.

In this way, the control unit 151 aligns the leading end of the medium at the position of the first conveyance roller 117 by controlling the first conveyance roller 117 to stop or rotate in the reverse direction A7 for the predetermined time and control the feed roller 112 to rotate in the media feeding direction A4. Accordingly, the control unit 151 can favorably correct the skew of the medium when the medium is conveyed in an inclined manner.

In particular, in a case where the determination unit 152 determines that the trailing end of the preceding medium has passed the second conveyance roller 121 when the fifth media sensor 120 detects the leading end of the following medium, the control unit 151 executes the alignment of the leading end of the following medium. As described above, the media conveying apparatus 100 includes the third motor 133 as a common motor for driving the first conveyance roller 117 and the second conveyance roller 121. Therefore, when the control unit 151 stops or rotates the first conveyance roller 117 in the reverse direction A7, the second conveyance roller 121 also stops or rotates in the reverse direction A7. The control unit 151 can execute the alignment of the leading end of the medium without hindering the forward movement of the preceding medium by executing the alignment of the leading end of the following medium after the trailing end of the preceding medium passed the second conveyance roller 121. Accordingly, the media conveying apparatus 100 can appropriately align the leading end of a medium while favorably conveying multiple media.

In step S110, the control unit 151 controls the third motor 133 to rotate the first conveyance roller 117 and the second conveyance roller 121 in the forward directions A6 and A10, respectively. At this time, the first driven roller 118 is rotated in the forward direction A8 by the rotation of the first conveyance roller 117 whereas the second driven roller 122 is rotated in the forward direction A11 by the rotation of the second conveyance roller 121.

Thus, the first conveyance roller 117, the first driven roller 118, the second conveyance roller 121, and the second driven roller 122 convey downstream the medium (following medium) that is being fed and has its leading end aligned. Then, the control unit 151 proceeds the process to step S121.

When the determination unit 152 determines that the trailing end of the preceding medium has not passed the second conveyance roller 121 (NO in step S107), in step S111, the control unit 151 detects the inclination of the leading end of the following medium being fed. The control unit 151 detects the inclination of the leading end of the following medium, for example, based on the second media signal and the third media signal stored in the storage device 140. The control unit 151 detects the latest time at which the signal value of the second media signal changes from a value indicating the absence of a medium to a value indicating the presence of a medium as the time at which the leading end of the following medium passes the position of the second media sensor 114. Similarly, the control unit 151 detects the latest time at which the signal value of the third media signal changes from a value indicating the absence of a medium to a value indicating the presence of a medium as the time at which the leading end of the following medium passes the position of the third media sensor 115. The control unit 151 calculates an inclination θ2 of the leading end of the following medium using the following Expression (3).

$$\theta 2 = \tan^{-1}(T2 \times V2/W0) \tag{3}$$

In Equation (3), T2 represents a time difference between the time when the leading end of the following medium passes the position of the second media sensor 114 and the time when the leading end of the following medium passes the position of the third media sensor 115. V2 represents the conveyance speed of the following medium. In other words, (T2×V2) indicates the difference in the distance in the media conveyance direction A1 between the leading end of the following medium at the position of the second media sensor 114 and the leading end of the following medium at the position of the third media sensor 115.

In step S112, the control unit 151 determines whether the leading end of the following medium has reached the first conveyance roller 117.

The control unit 151 calculates a second distance, which is the distance by which the leading end of the following medium has moved from the position of the fourth media sensor 116. The control unit 151 calculates a second distance Y2 using the following Equation (4). The second distance Y2 is the distance by which the leading end of the following medium has moved from the position of the fifth media sensor 120 to a position P2. The position P2 is the outer end in the width direction A2 of the nip formed by the first conveyance roller 117 and the first driven roller 118 located on the same side as the leading side of the following medium. In the following description, the nip formed by the first conveyance roller 117 and the first driven roller 118 may be referred to as a conveyance area.

$$Y2 = (W2/2) \times \tan\theta 2 \quad (4)$$

In Equation (4), W2 represents the distance between the outer ends of the nips formed by each pair of the first conveyance roller 117 and the first driven roller 118 in the width direction A2 as illustrated in FIG. 8.

When the second distance Y2 is greater than a distance L2 between the fourth media sensor 116 and a predetermined position C2 in the conveyance area in the media conveyance direction A1, the control unit 151 determines that the leading end of the following medium has reached the first conveyance roller 117. The predetermined position C2 is set, for example, at the center position of the conveyance area. Alternatively, the predetermined position C2 may be set at a position where a straight line passing through the rotation center of the first conveyance roller 117 and the rotation center of the first driven roller 118 intersects with the conveyance area. Alternatively, the predetermined position C2 may be set at an upstream end position of the conveyance area. By contrast, when the second distance Y2 is equal to or less than the distance L2, the control unit 151 determines that the leading end of the following medium has not reached the first conveyance roller 117.

In this way, the control unit 151 determines whether the leading end of the medium has reached the first conveyance roller 117 based on the detected inclination of the leading end of the medium and the fourth media signal from the fourth media sensor 116. Accordingly, the control unit 151 can determine whether the leading end of the medium has reached the first conveyance roller 117 with high accuracy.

The control unit 151 may determine that the leading end of the medium has not reached the first conveyance roller 117 when the leading end of the medium passes the position of the fourth media sensor 116, without considering the inclination of the leading end of the medium.

The control unit 151 may determine whether the leading end of the medium has reached the first conveyance roller 117 based on whether a first time or longer has elapsed since the start of the feeding of the medium, without using the fourth media signal from the fourth media sensor 116. The first time is set to the time required for a medium to move from the feed roller 112 to the first conveyance roller 117.

When the control unit 151 determines that the leading end of the following medium has not reached the first conveyance roller 117 (NO in step S112), in step S113, the control unit 151 controls the first motor 131 to stop the feed roller 112. When a preceding medium is present, the first conveyance roller 117, the first driven roller 118, the second conveyance roller 121, and the second driven roller 122 are controlled to rotate in the forward directions A6, A8, A10, and A11, respectively, in step S110, S118, or S120. However, since the leading end of the following medium has not reached the first conveyance roller 117, the halt of the feed roller 112 stops the following medium at a position before the first conveyance roller 117 and prevents the following medium from moving downstream.

In step S114, the determination unit 152 waits until the trailing end of the preceding medium passes the second conveyance roller 121. The determination unit 152 determines whether the trailing end of the preceding medium has passed the second conveyance roller 121 as in the operation in step S107. At this point, the trailing end of the preceding medium has moved from the position of the fifth media sensor 120 by the first distance Y1 calculated in step S107 to the position P1 of the outer end of the conveyance area on the same side as the lagging side of the preceding medium. Therefore, the determination unit 152 waits for the time required for the preceding medium to move by a distance obtained by subtracting the first distance Y1 from the distance L1, which is the distance between the fifth media sensor 120 and the predetermined position C1 of the conveyance area. The preceding medium is ejected to the ejection table 104 when the preceding medium has passed the second conveyance roller 121.

As described above, in a case where the determination unit 152 does not determine that the trailing end of the preceding medium has passed the second conveyance roller 121 when the fifth media sensor 120 detects the leading end of the following medium, the control unit 151 controls the feed roller 112 to stop feeding the following medium until the trailing end of the preceding medium passes the second conveyance roller 121. Thus, the media conveying apparatus 100 can reliably separate the preceding medium from the second conveyance roller 121 before the following medium reaches the first conveyance roller 117.

Accordingly, when the following medium reaches the first conveyance roller 117, the media conveying apparatus 100 can appropriately align the leading end of the following medium with the first conveyance rollers 117 without hindering the conveyance of the preceding medium performed by the second conveyance roller 121 that operates in conjunction with the first conveyance roller 117.

In step S115, the control unit 151 drives the first motor 131 again to rotate the feed roller 112 again. Thus, the control unit 151 restarts feeding the following medium. The following medium moves toward the first conveyance roller 117.

In step S116, the control unit 151 controls the third motor 133 to stop the first conveyance roller 117 or rotate the first conveyance roller 117 in the reverse direction A7 as in the operation in step S108. As described above, when the control unit 151 stops the first conveyance roller 117 or rotates the first conveyance roller 117 in the reverse direction A7, the second conveyance roller 121 also stops or rotates in the reverse direction A7. However, since the preceding medium has already passed the second conveyance roller 121 in step S114, the forward movement of the preceding medium is not hindered.

In step S117, the control unit 151 waits until the predetermined time elapses to align the leading end of the medium at the position of the first conveyance roller 117 as in the operation in step S109.

In this way, in a case where the determination unit 152 determines that the trailing end of the preceding medium has passed the second conveyance roller 121, the control unit 151 controls the feed roller 112 to restart feeding the following medium to align the leading end of the following medium. Accordingly, the media conveying apparatus 100 can appropriately guide the following medium to the position of the first conveyance roller 117 after the preceding medium is separated from the second conveyance roller 121 to appropriately align the leading end of the following medium with the first conveyance rollers 117.

In addition, the control unit 151 executes the alignment of the leading end of the following medium in a case where the determination unit 152 determines that the trailing end of the preceding medium has passed the second conveyance roller 121 after the fifth media sensor 120 detects the leading end of the following medium and before the leading end of the following medium reaches the first conveyance roller 117. Thus, the media conveying apparatus 100 can align the leading end of the following medium in a case where the trailing end of the preceding medium has not passed the second conveyance roller 121 when the leading end of the following medium passes the position of the fifth media sensor 120. Accordingly, the media conveying apparatus 100 can increase the execution frequency of alignment of the medium and correct the skew of the medium more frequently.

In step S118, the control unit 151 controls the third motor 133 to rotate the first conveyance roller 117 and the second conveyance roller 121 in the forward directions A6 and A10, respectively, as in the operation in step S110. Then, the control unit 151 proceeds the process to step S121.

When the control unit 151 determines that the leading end of the following medium has reached the first conveyance roller 117 (YES in step S112), in step S119, the control unit 151 determines not to execute the alignment of the leading end of the following medium.

When the leading end of the following medium has already reached the first conveyance roller 117 before the trailing end of the preceding medium passes the second conveyance roller 121, the second conveyance roller 121 and the first conveyance roller 117 are in contact with the preceding medium and the following medium, respectively. If the control unit 151 rotates the second conveyance roller 121 in the forward direction A10 in this state, the following medium moves further downstream together with the preceding medium, making it difficult for the first conveyance roller 117 to align the leading end of the following medium. If the control unit 151 stops the first conveyance roller 117, the preceding medium does not move downstream. In this case, the control unit 151 continues the conveyance of the medium without executing the alignment of the leading end of the following medium to prevent a delay in the conveyance of the preceding medium.

The operation in step S112 may be omitted, and the control unit 151 may determine not to execute the alignment of the leading end of the following medium regardless of whether the leading end of the following medium has reached the first conveyance roller 117. In other words, in a case where the determination unit 152 does not determine that the trailing end of the preceding medium has passed the second conveyance roller 121 when the fifth media sensor 120 detects the leading end of the following medium, the control unit 151 does not execute the alignment of the leading end of the following medium. Accordingly, the control unit 151 can appropriately continue the conveyance of the preceding medium without executing the alignment of the leading end of the following medium when having difficulties in executing the alignment of the leading end of the following medium.

In step S120, the control unit 151 controls the third motor 133 to rotate the first conveyance roller 117 and the second conveyance roller 121 in the forward directions A6 and A10, respectively, as in the operation in step S110.

In step S121, the control unit 151 determines whether a medium remains on the media table 103 based on the first media signal received from the first media sensor 111. When a medium remains on the media table 103 (YES in step S121), the control unit 151 returns the process to step S104 and repeats the process from step S104 to step S121.

By contrast, when no medium remains on the media table 103 (NO in step S121), in step S122, the control unit 151 waits until the trailing end of the medium being conveyed (the following medium) passes the second conveyance roller 121. The control unit 151 periodically acquires the fifth media signal from the fifth media sensor 120 and determines that the trailing end of the medium has passed the position of the fifth media sensor 120 when the signal value of the fifth media signal changes from a value indicating the presence of a medium to a value indicating the absence of a medium. The control unit 151 determines that the trailing end of the medium has passed the second conveyance roller 121 when a second time has elapsed since the trailing end of the medium has passed the position of the fifth media sensor 120. The second time is set to the time obtained by adding a margin to the time required for a medium to move from the position of the fifth media sensor 120 to the second conveyance roller 121.

In step S123, the control unit 151 controls the first motor 131, the second motor 132, and the third motor 133 to stop the separation roller 113, the first conveyance roller 117, the first driven roller 118, the second conveyance roller 121, and/or the second driven roller 122. Thus, the control unit 151 ends the series of steps.

When the operation in step S112 is omitted and the determination unit 152 determines that the trailing end of the preceding medium has not passed the second conveyance roller 121 in step S107, the control unit 151 may always execute the process from step S113 to step S118.

When multiple media are conveyed, the separation roller 113 rotates in the direction A5 opposite to the media feeding direction and separates the medium in contact with the feed roller 112 from the other media. Therefore, the medium following the medium being fed is not fed until the trailing end of the medium being fed passes through the nip formed by the feed roller 112 and the separation roller 113. However, the control unit 151 may control the first motor 131 to stop the feed roller 112 after rotating the first conveyance roller 117 and the second conveyance roller 121 in step S110, S118, or S120. In this case, when the trailing end of the medium passes the position of the second media sensor 114, the third media sensor 115, or the fourth media sensor 116, the control unit 151 drives the first motor 131 again to rotate the feed roller 112 again. Thus, the control unit 151 restarts feeding the following medium. Accordingly, the media conveying apparatus 100 can further reduce the occurrence of the multi-feed of media.

Figure 10:
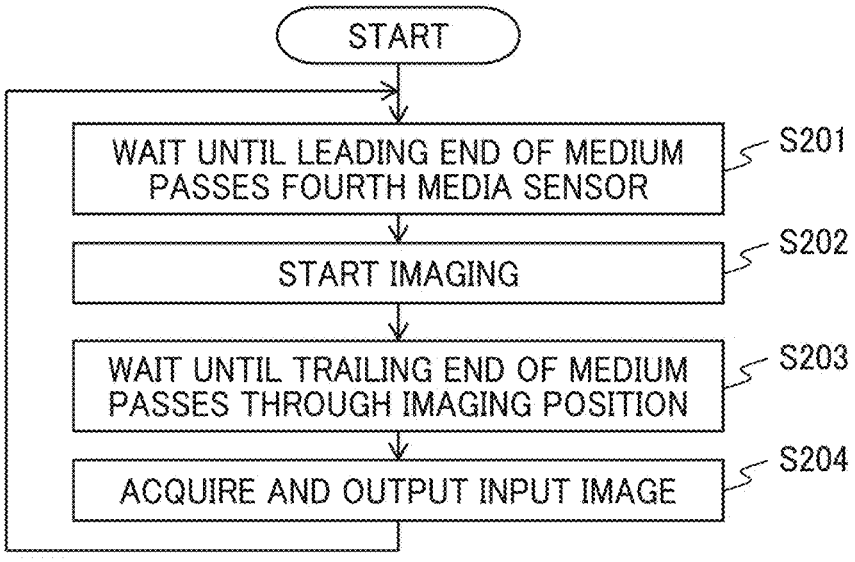
FIG. 10 is a flowchart of an example of a media reading process.

FIG. 10 is a flowchart of an example of a media reading process performed by the media conveying apparatus 100.

A description is given below of an example of the media reading process performed by the media conveying apparatus 100, with reference to the flowchart of FIG. 10. The sequence of operations described below is executed by, e.g., the processing circuit 150 in cooperation with the components of the media conveying apparatus 100 based on the program prestored in the storage device 140. The flowchart illustrated in FIG. 10 is executed in parallel with the media conveying process during the execution of the media conveying process.

In step S201, the control unit 151 waits until the leading end of a medium passes the position of the fourth media sensor 116. The control unit 151 periodically acquires the fourth media signal from the fourth media sensor 116 and determines that the leading end of the medium has passed the position of the fourth media sensor 116 when the signal value of the fourth media signal changes from a value indicating the presence of a medium to a value indicating the absence of a medium.

In step S202, the control unit 151 causes the imaging device 119 to start imaging the medium.

In step S203, the control unit 151 waits until the trailing end of the medium passes through the imaging position in the imaging device 119. The control unit 151 periodically acquires the fifth media signal from the fifth media sensor 120 and determines that the trailing end of the medium has passed the position of the fifth media sensor 120 when the signal value of the fifth media signal changes from a value indicating the presence of a medium to a value indicating the absence of a medium. The control unit 151 determines that the trailing end of the medium has passed through the imaging position when the trailing end of the medium has passed the position of the fifth media sensor 120. The control unit 151 may determine whether the trailing end of the medium has passed through the imaging position using the fourth media signal from the fourth media sensor 116 instead of the fifth media signal from the fifth media sensor 120. In this case, the control unit 151 determines that the trailing end of the medium has passed through the imaging position when a third time has elapsed since the trailing end of the medium has passed the position of the fourth media sensor 116. The third time is set to the time obtained by adding a margin to the time required for a medium to move from the position of the fourth media sensor 116 to the imaging position.

In step S204, the control unit 151 acquires an input image from the imaging device 119 and transmits (i.e., outputs) the acquired input image to the information processing device via the interface device 134. The control unit 151 then returns the process to step S201, and repeats the process from step S201 to step S204 while the media conveying process is executed.

As described above in detail, the media conveying apparatus 100 drives the first conveyance roller 117 and the second conveyance roller 121 with the common third motor 133. When the trailing end of the preceding medium passes the second conveyance roller 121 before the leading end of the following medium reaches the first conveyance roller 117, the media conveying apparatus 100 aligns the leading end of the following medium. Thus, the media conveying apparatus 100 can appropriately align the leading end of the medium with the first conveyance rollers 117 while preventing an increase in the cost of the media conveying apparatus 100. Further, the media conveying apparatus 100 can appropriately align the leading end of the medium with the first conveyance rollers 117 while preventing an increase in the size and weight of the media conveying apparatus 100.

When the first conveyance roller 117 that aligns the leading end of the medium and the second conveyance roller 121 that ejects the medium are driven by a common motor, two continuously fed media need to be sufficiently separated to rotate each roller in a desired direction at a desired time. However, when the distance between the media is increased, the time required for the media conveying process increases. The media conveying apparatus 100 aligns the leading end when the alignment of the leading end does not cause any problem during the media conveying process so that the distance between the media when the leading end is aligned can be the same as the distance between the media when the leading end is not aligned. Accordingly, the media conveying apparatus 100 can appropriately align the leading end of the medium with the first conveyance rollers 117 while preventing an increase in the time required for the media conveying process.

The time required for separating and feeding a medium varies depending on, e.g., the type of the medium being fed and the load applied to the medium being fed (the amount of media collectively placed on the media table 103). Therefore, the distance between two media which are continuously fed varies depending on, e.g., the type of the media being fed and the load applied to the media being fed. The media conveying apparatus 100 determines whether to align the leading end of the medium based on the distance between the medium being fed and the medium preceding the medium being fed when the medium being fed passes the position of the fourth media sensor 116 located upstream from the first conveyance roller 117 that aligns the leading end of the medium. Accordingly, the media conveying apparatus 100 can determine whether the leading end of the medium can be aligned without hindering the conveyance of the preceding medium and appropriately align the leading end of the medium with the first conveyance rollers 117 with high accuracy.

Figure 11:
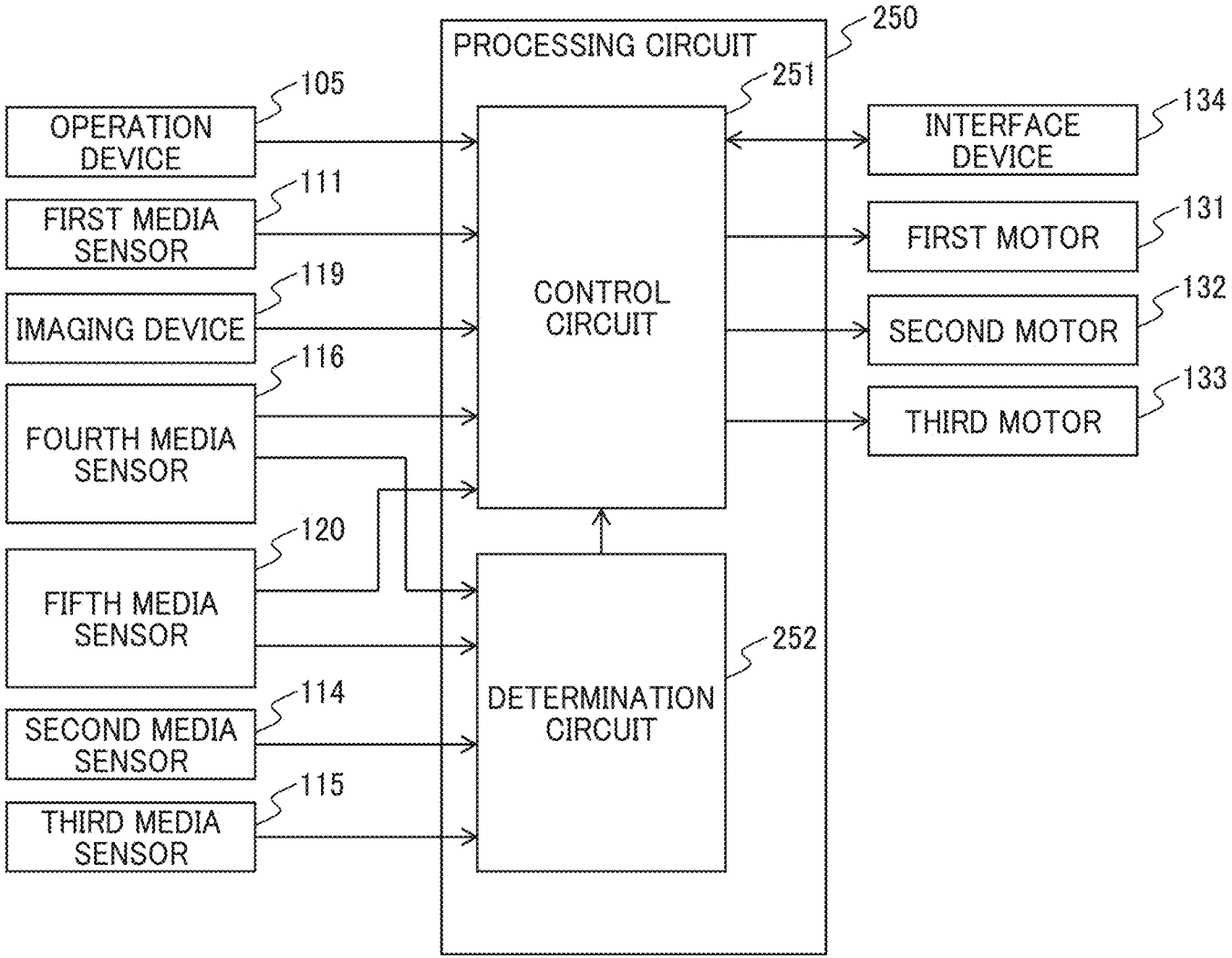
FIG. 11 is a schematic diagram illustrating a configuration of a processing circuit according to another embodiment of the present disclosure.

FIG. 11 is a schematic diagram illustrating a configuration of a processing circuit 250 of a media conveying apparatus according to another embodiment. The processing circuit 250 substitutes for the processing circuit 150 and executes, e.g., the media reading process instead of the processing circuit 150. The processing circuit 250 includes a control circuit 251 and a determination circuit 252. These circuits may be, e.g., independent integrated circuits, microprocessors, or firmware.

The control circuit 251 is an example of a control unit and functions as the control unit 151. The control circuit 251 receives the operation signal from the operation device 105 or the interface device 134. The control circuit 251 receives the first media signal, the fourth media signal, and the fifth media signal from the first media sensor 111, the fourth media sensor 116, and the fifth media sensor 120, respectively, and receives the result of determination of the position of a medium from the determination circuit 252. The control circuit 251 controls the first motor 131, the second motor 132, and the third motor 133 based on the received information, acquires an input image from the imaging device 119, and outputs the input image to the interface device 134.

The determination circuit 252 is an example of a determination unit and functions as the determination unit 152. The determination circuit 252 receives the second media signal, the third media signal, the fourth media signal, and the fifth media signal from the second media sensor 114, the third media sensor 115, the fourth media sensor 116, and the fifth media sensor 120, respectively. The determination circuit 252 determines the position of the conveyed medium based on the received signals and outputs the result of determination to the control circuit 251.

As described above in detail, the media conveying apparatus 100 including the processing circuit 250 can appropriately align the leading end of the medium with the first conveyance rollers 117 while preventing an increase in the cost of the media conveying apparatus 100.

According to one or more embodiments of the present disclosure, the media conveying apparatus, the media conveying method, and the control program can appropriately align the leading end of the medium with the conveyance roller while preventing an increase in the cost of the media conveying apparatus.

The above-described embodiments are illustrative and do not limit the present invention. Thus, numerous additional modifications and variations are possible in light of the above teachings. For example, elements and/or features of different illustrative embodiments may be combined with each other and/or substituted for each other within the scope of the present invention. Any one of the above-described operations may be performed in various other ways, for example, in an order different from the one described above.

The functionality of the elements disclosed herein may be implemented using circuitry or processing circuitry which includes general purpose processors, special purpose processors, integrated circuits, application-specific integrated circuits (ASICs), field-programmable gate arrays (FPGAs), and/or combinations thereof which are configured or programmed, using one or more programs stored in one or more memories, to perform the disclosed functionality. Processors are considered processing circuitry or circuitry as they include transistors and other circuitry therein. In the disclosure, the circuitry, units, or means are hardware that carry out or are programmed to perform the recited functionality. The hardware may be any hardware disclosed herein which is programmed or configured to carry out the recited functionality.

There is a memory that stores a computer program which includes computer instructions. These computer instructions provide the logic and routines that enable the hardware (e.g., processing circuitry or circuitry) to perform the method disclosed herein. This computer program can be implemented in known formats as a computer-readable storage medium, a computer program product, a memory device, a record medium such as a CD-ROM or DVD, and/or the memory of an FPGA or ASIC.

The invention claimed is:

1. A media conveying apparatus, comprising:

a feed roller to feed media;

a first conveyance roller located downstream from the feed roller in a media conveyance direction to convey media in the media conveyance direction by rotating in a forward direction;

a second conveyance roller located downstream from the first conveyance roller in the media conveyance direction to convey the media in the media conveyance direction;

a motor to drive the first conveyance roller and the second conveyance roller simultaneously;

a sensor located upstream from the first conveyance roller in the media conveyance direction; and circuitry configured to:

determine whether a trailing end of each medium of the media has passed the second conveyance roller; and execute alignment of a leading end of the each medium at a position of the first conveyance roller by controlling the first conveyance roller and the feed roller, wherein the circuitry stops the first conveyance roller or rotates the first conveyance roller in a reverse direction and controls the feed roller to align a leading end of a first medium among the media in a case where the circuitry determines that a trailing end of a second medium among the media preceding the first medium has passed the second conveyance roller when the sensor detects the leading end of the first medium.

2. The media conveying apparatus according to claim 1, wherein the circuitry does not execute the alignment of the leading end of the first medium in a case where the circuitry does not determine that the trailing end of the second medium has passed the second conveyance roller when the sensor detects the leading end of the first medium.

3. The media conveying apparatus according to claim 2, wherein the circuitry is configured to execute the alignment of the leading end of the first medium in a case where the circuitry determines that the trailing end of the second medium has passed the second conveyance roller after the sensor detects the leading end of the first medium and before the leading end of the first medium reaches the first conveyance roller.

4. The media conveying apparatus according to claim 3, wherein the circuitry is configured to:

detect an inclination of the leading end of the each medium of the media; and determine whether the leading end of the each medium has reached the first conveyance roller based on the detected inclination and an output signal from the sensor.

5. The media conveying apparatus according to claim 1, wherein the circuitry controls the feed roller to stop feeding the first medium until the trailing end of the second medium passes the second conveyance roller in a case where the circuitry does not determine that the trailing end of the second medium has passed the second conveyance roller when the sensor detects the leading end of the first medium.

6. The media conveying apparatus according to claim 5, wherein the circuitry is configured to control the feed roller to restart feeding the first medium and execute the alignment of the leading end of the first medium when the circuitry determines that the trailing end of the second medium has passed the second conveyance roller.

7. The media conveying apparatus according to claim 1, further comprising another sensor located upstream from the second conveyance roller in the media conveyance direction, wherein the circuitry is configured to:

detect an inclination of the trailing end of the each medium of the media; and determine whether the trailing end of the each medium has passed the second conveyance roller based on the detected inclination and an output signal from said another sensor.

8. A media conveying method, comprising:

feeding media by a feed roller;

driving a first conveyance roller and a second conveyance roller simultaneously by a motor, wherein the first conveyance roller is located downstream from the feed roller in a media conveyance direction and conveys the media in the media conveyance direction by rotating in a forward direction, and the second conveyance roller is located downstream from the first conveyance roller in the media conveyance direction and conveys the media in the media conveyance direction by rotating in the forward direction;

determining whether a trailing end of each medium of the media has passed the second conveyance roller; and executing alignment of a leading end of the each medium at a position of the first conveyance roller, wherein the executing includes stopping the first conveyance roller or rotating the first conveyance roller in a reverse direction and controlling the feed roller to align a leading end of a first medium among the media in a case where the determining determines that a trailing end of a second medium among the media preceding the first medium has passed the second conveyance roller when the leading end of the first medium is detected by a sensor located upstream from the first conveyance roller in the media conveyance direction.

9. A non-transitory recording medium storing a plurality of instructions which, when executed by one or more processors, causes the one or more processors to perform a method for controlling a media conveying apparatus including a feed roller, a first conveyance roller located downstream from the feed roller in a media conveyance direction, a second conveyance roller located downstream from the first conveyance roller in the media conveyance direction, and a sensor, the method comprising:

determining whether a trailing end of each medium of media has passed the second conveyance roller; and executing alignment of a leading end of the each medium at a position of the first conveyance roller, wherein the executing includes stopping the first conveyance roller or rotating the first conveyance roller in a reverse direction and controlling the feed roller to align a leading end of a first medium among the media in a case where the determining determines that a trailing end of a second medium among the media preceding the first medium has passed the second conveyance roller when the leading end of the first medium is detected by the sensor.

* * * * *